US005575263A

United States Patent [19]

Pontoppidan et al.

[11] Patent Number: 5,575,263

[45] Date of Patent: Nov. 19, 1996

[54] FUEL-DISPERSING SKIRT FOR AN INJECTOR OF A FUEL-INJECTED ENGINE

[75] Inventors: Michael Pontoppidan, Rueil-Malmaison; Bruno Covin, Boulogne-Billancourt; Jean C. Lucas, Cergy; Christophe Preterre, Paris, all of France

[73] Assignee: Magneti Marelli France, Nanterre Cedex, France

[21] Appl. No.: 563,052

[22] Filed: Nov. 27, 1995

[30] Foreign Application Priority Data

Dec. 1, 1994 [FR] France ..... 94 14456

[51] Int. Cl.[6] ..... F02M 55/02; F02B 15/00

[52] U.S. Cl. ..... 123/470; 123/432

[58] Field of Search ..... 123/470, 472, 123/432, 305, 184.38, 184.31, 184.52, 184.21, 445

[56] References Cited

U.S. PATENT DOCUMENTS

| | | | |
|---|---|---|---|
| 4,671,234 | 6/1987 | Tegtmeier | 123/432 |
| 4,945,877 | 8/1990 | Ziegler et al. | 123/472 |
| 4,982,716 | 1/1991 | Takeda et al. | 123/470 |
| 5,138,989 | 8/1992 | Fraidl et al. | 123/193.05 |
| 5,146,897 | 9/1992 | Hattori | 123/470 |
| 5,150,691 | 9/1992 | Imajo | 123/472 |
| 5,156,124 | 10/1992 | Sugimoto et al. | 123/432 |
| 5,203,299 | 4/1993 | Ueda | 123/432 |
| 5,265,568 | 11/1993 | Nakagawa | 123/306 |

FOREIGN PATENT DOCUMENTS 0544978 6/1993 European Pat. Off. .

*Primary Examiner*—Thomas N. Moulis
*Attorney, Agent, or Firm*—Henderson & Sturm

[57] ABSTRACT

The tubular skirt (12) in the partition between the air ports (2, 3) supports the injector (11) and forms two fuel passages (19) emerging in the ports (2, 3) between two opposed lateral walls (15) each thinned to a bevel (16) toward the downstream end with a free edge (17) in the form of a thin blade and with a notch having concavity turned toward the downstream end, a region (23) of the internal face of each lateral wall (15) upstream of the bevel (16) preferably being struck by at least one jet of fuel coming from the injector (11).

Application to fuel-injected engines with two inlet valves per cylinder.

14 Claims, 3 Drawing Sheets

FUEL-DISPERSING SKIRT FOR AN INJECTOR OF A FUEL-INJECTED ENGINE

The invention relates to a skirt for dispersing the fuel which it receives from a multi-hole, preferably two-hole injector and which is transferred into two air intake ports separated from one another by a partition, for supplying a combustion chamber of a fuel-injected internal combustion engine and, particularly an engine having at least two inlet valves per combustion chamber, the injector being arranged substantially between the air ports, and the skirt having a tubular overall shape and being arranged in the partition downstream of the injector which it houses at least partially in its upstream part, exhibiting preferably an axisymmetric shape, whereas at least its downstream part forms two fuel passages communicating with one another toward the inside of the skirt each emerging in one respectively of the two air ports via an outlet orifice, and delimited between two opposed lateral walls of the skirt.

European Patent Application EP-A-0,544,978 describes a skirt of this type, produced in the form of an adaptor piece mounted removably directly in the cylinder head of the engine, and more specifically in a housing formed partially in a partition for forming and separating the two air ports in the cylinder head of the engine.

This skirt includes, at its downstream end, a central partition element which is incorporated into the partition which forms and separates the air ports in the cylinder head so as to extend it, when the removable skirt is fitted into the cylinder head, and this central partition element is pierced with an opening for communication between the air ports, in the region of the outlet of the fuel passages of the skirt.

Figure 2:
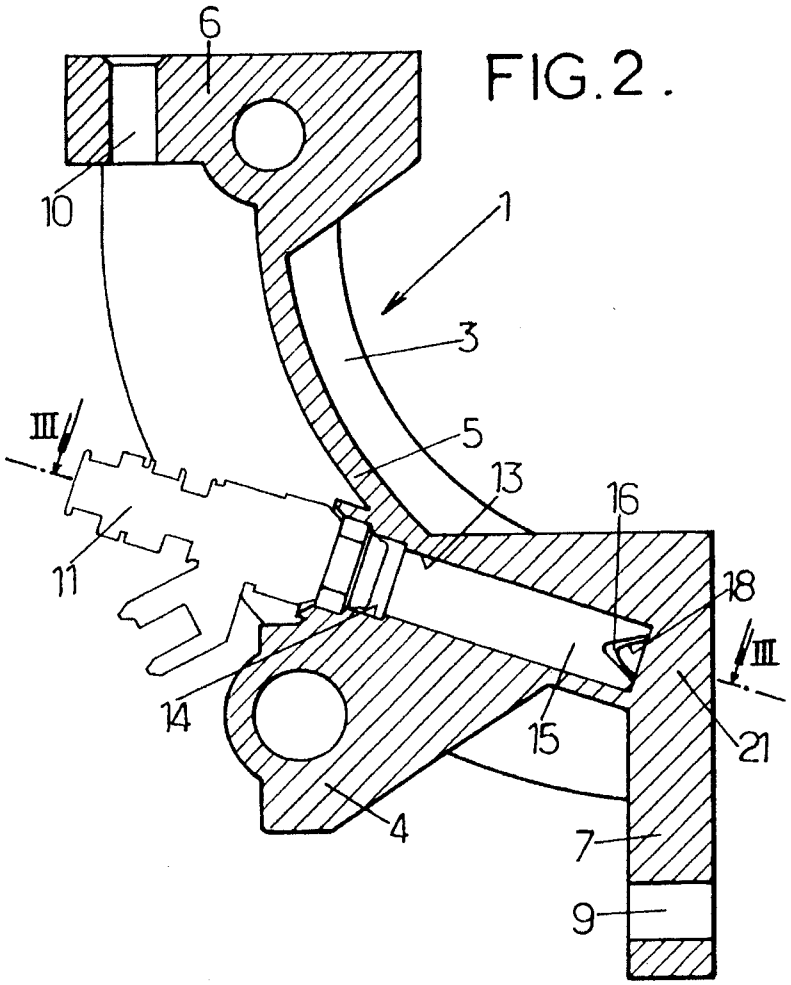

Mounting the injector and the skirt directly in the cylinder head, as represented in FIGS. 2 and 3*a* of the aforementioned document has the drawbacks that the skirt cannot be used as an active diffuser for the fuel coming from the injector, and that the cylinder head is more complicated and expensive to produce.

The object of the invention is to overcome these drawbacks, and in particular to propose a fuel-dispersing skirt which can be used as an active diffuser for the fuel coming from the injector to give better preparation of the air/fuel mixture than that obtained with a skirt of the type described in EP-A-0,544,978.

Another object of the invention is to propose a fuel-dispersing skirt which is better suited to the various practical requirements than known ones, and especially which can be mounted on an intake manifold or tract which is otherwise of conventional structure.

To this end, the invention proposes a dispersing skirt of the type outlined hereinabove, which is characterized in that at least close to the outlet orifices of the fuel passages, each of the opposed lateral walls is progressively thinned to a bevel of thickness and/or width decreasing from upstream to downstream as far as its downstream free edge in the form of a thin blade, and in which edge there is made a concave notch with concavity turned toward the downstream end.

The concave notches in the free edges in the form of thin blades of the opposed walls of the skirt make it possible for films of fuel coming from the edges of the bevels to be torn away by the energy contained in the flow of air in the adjacent ports, such that an excellent preparation of the air/fuel mixture is ensured.

Concave openings with concavity turned toward the downstream end are indeed exhibited by the skirt described in EP-A-0,544,978. However, the concave openings are made in the skirt only to free access to the communication opening made in the central partition element, and to contrive for this skirt not to project into the two air ports, and not to cause any drop in pressure head prejudicial to the flow of air into these ports. Furthermore, the downstream free edges of the lateral walls do not have the shape of thinned and notched blades like a whistle, so that the skirt described in EP-A-0,544,978 cannot provide for the good diffusion of the fuel into the air which is obtained by virtue of the specific shape of the skirt of the invention. This good diffusion results, according to the invention, from the presence of the concave notches in the edges in the shape of thinned blades of the opposed lateral walls of the skirt.

When the structure and the geometry of the cylinder head and/or of the air intake tract are such that the distance between the tip of the injector and the corresponding inlet valve or valves is relatively long, the dispersing skirt of the invention is advantageously such that each lateral wall exhibits, upstream of the corresponding concave notch, a region of its internal face which is intended to be struck by one, respectively, of the jets of fuel coming from the injector.

The skirt thus produced, obtained by adapting its geometry and particularly its length, to suit the injector and especially the angle of separation or of divergence between the jets of fuel leaving the injector, gives a post-atomization effect, using the thinned trailing edge of the blades as a post-diffuser. The post-atomization region is thus brought close to the inlet valve or valves, and an angular recentering of the jets of fuel leaving the injector is obtained through their being deflected by the lateral walls. The advantages of this structure are that of minimizing the formation of films of liquid fuel on the wall in the extension, termed housing, of the intake port in the cylinder head, close to the inlet valve seat or seats, and that of affording greater insensitivity to a variation in the angle of separation between the jets of fuel leaving the injector.

Of course, when the distance between the tip of the injector and the corresponding inlet valve or valves is not too long, the dispersing skirt may be relatively shorter than in the variation hereinabove and/or interact with a two-hole injector for which the angle of separation between the jets is relatively smaller, so that the skirt may allow the jets of fuel to pass freely through the space between its lateral walls as far as the outlet orifices of the fuel passages, which emerge in the two air ports, limiting the post-atomization effect to cases in which a liquid film of fuel forms on the walls of the skirt.

The bevels of the opposed lateral walls may delimit between them a passage of constant transverse section or, for preference, a passage diverging from upstream to downstream, but in no case should this passage converge toward the downstream end, in order to obtain the desired correct diffusion of fuel.

Each fuel passage may be delimited between one respectively of the opposed lateral walls of the skirt and the partition separating air ports, but it is also possible, as known from EP-A-0,544,978, for each fuel passage to be delimited between one of the lateral walls and a central partition element of the skirt, at its downstream end, to separate from one another the two fuel passages and also, moreover, the two air ports.

If it is desired for the axes of the fuel passages to be substantially parallel to one another, and also possibly to the axes of the air ports, it is advantageous according to a first embodiment, for the bevels of the opposed lateral walls to be formed at the downstream end part of a preferably axisymmetric central bore of the skirt.

In contrast, if it is desired for the axes of the fuel passages to diverge from one another toward the downstream end, it is advantageous for the bevels of the opposed lateral walls to be formed by a divergent downstream part of a central bore of the skirt.

To this end, the divergent downstream part of the central bore may connect to a preferably axisymmetric throat of smaller transverse section of this bore, by a substantially radial shoulder, according to a first variation, or may diverge progressively from the throat of the bore, according to a second variation.

In the various embodiments, and as known per se from EP-A-0,544,978, it is advantageous for the central bore of the skirt to exhibit an upstream end part of widened section forming a seat for the injector.

According to one feature inherent to the invention, the skirt is of a single piece with an air intake tract element comprising at least two air ports associated with one combustion chamber, and extending between a flange for connection to a tract plenum and a flange for fixing to the cylinder head of the engine, in which flanges the ports each emerge respectively via an inlet orifice at its upstream end and an outlet orifice at its downstream end, the skirt being incorporated into a partition which forms and separates the two ports. Of course, as one skirt is provided for each combustion chamber of the engine, all the skirts may, in accordance with the invention, be incorporated into the tract for letting air into the engine, this tract having a body made of a single piece equipped with skirts each supporting the corresponding injector, and so that the tract is in the form of a preassembled and preset component, which is fixed directly to the cylinder head of the engine. However, the skirt according to the invention may equally well be mounted removably in an air intake tract element as defined hereinabove, in which case the skirt is fitted into a housing made in a partition for forming and separating the two ports.

Finally, and as known from EP-A-0,544,978, the skirt according to the invention may also be mounted removably in a housing made in a partition for forming and separating the two air ports directly in the cylinder head of the engine.

Figure 1:
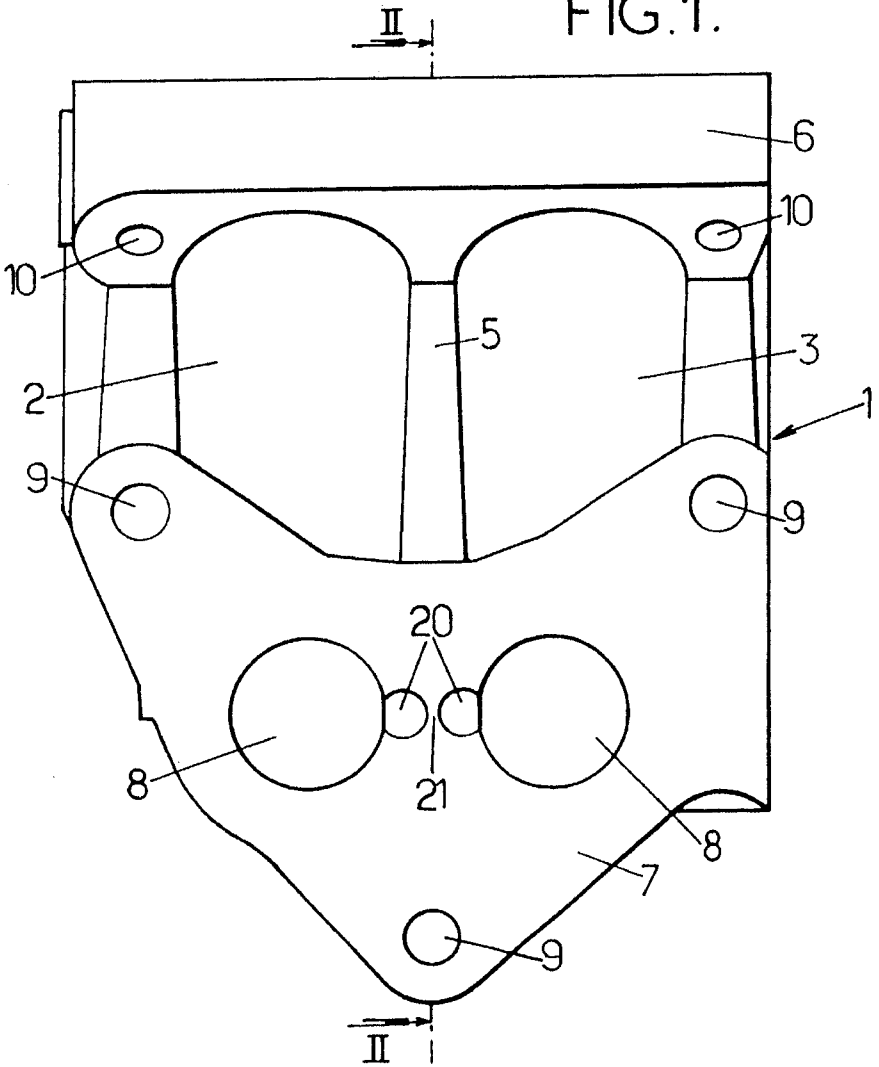
Figure 3:
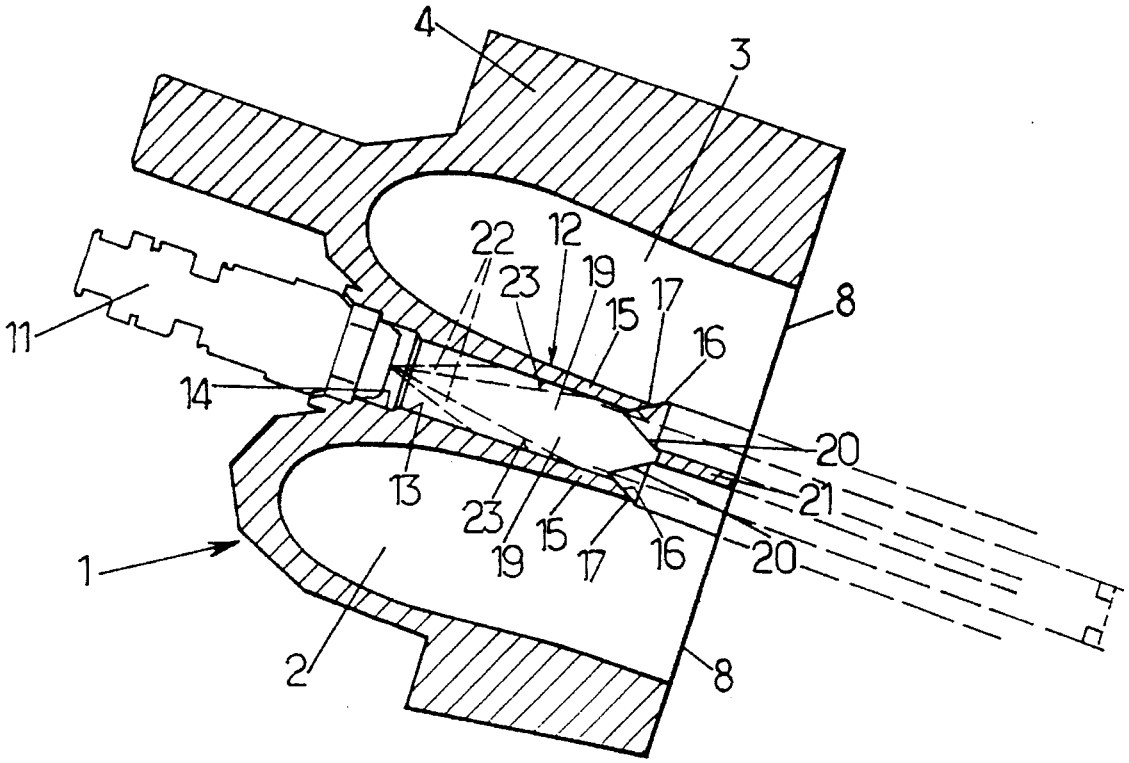
Figure 5:
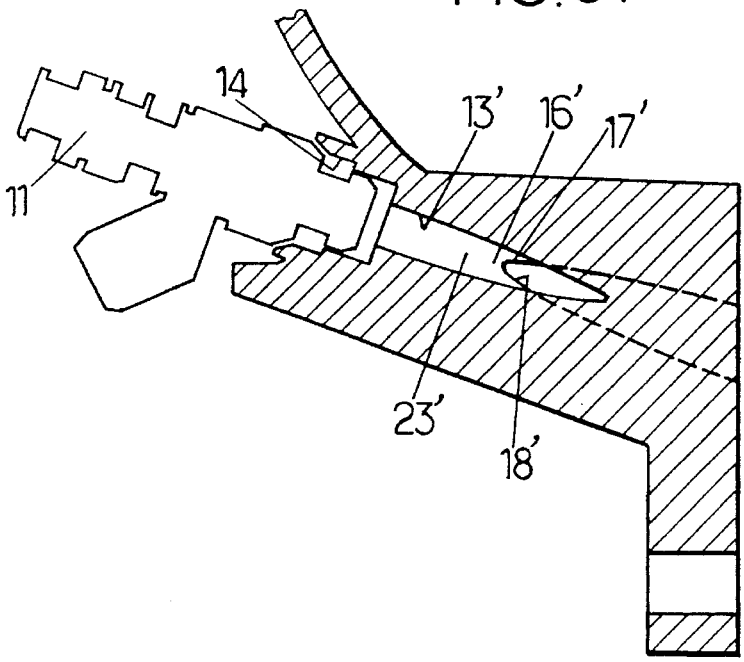
Figure 4:
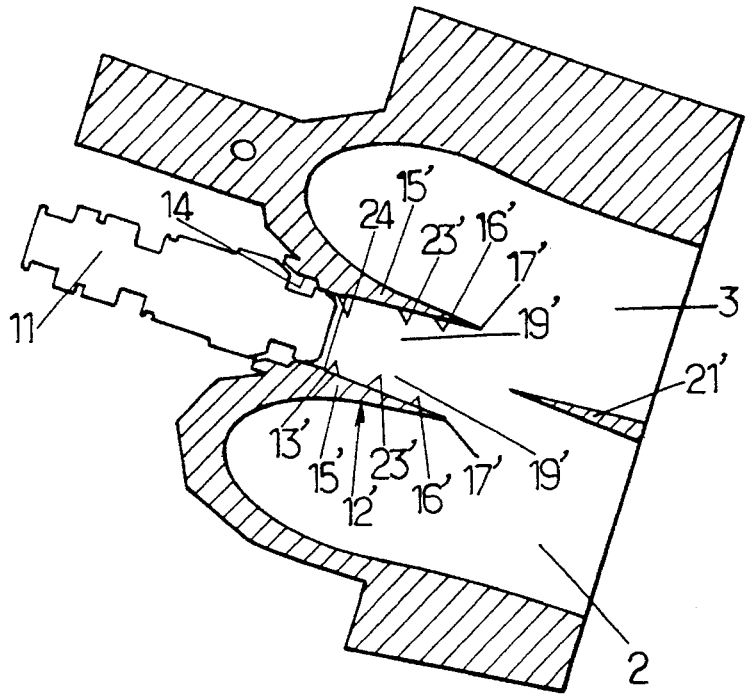
Figure 6:
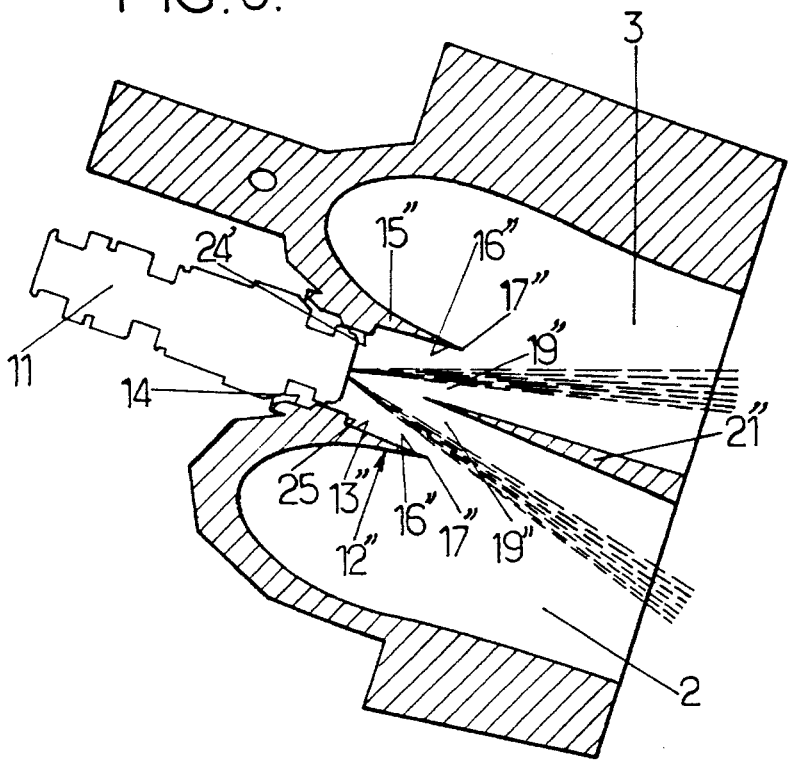

Other features and advantages of the invention will stem from the description given hereinbelow, without implied limitation, of embodiments described with reference to the appended drawings in which:

FIG. 1 is a diagrammatic view in side elevation of a tract element with two air intake ports and an integrated fuel-dispersing skirt, FIG. 2 is a section through the middle on the plane II—II of FIG. 1, FIG. 3 is a transverse section on the plane III—III of FIG. 2, FIGS. 4 and 5 are view substantially similar respectively to FIGS. 3 and 2 for an alternative embodiment of the fuel-dispersing skirt, and FIG. 6 is a view similar to FIG. 3 for a second skirt alternative.

FIGS. 1 to 3 represent an air intake tract element 1, at least partially made of metal or, for preference, molded as a single piece from a synthetic substance such as a thermoplastic, for supplying a cylinder or combustion chamber of a fuel-injected internal combustion engine with air, and of the type comprising for example at least two inlet valves per cylinder or combustion chamber.

The tract element 1 comprises two air ports 2 and formed substantially side by side in its body 4, and separated from one another by a partition 5 which delimits them in their adjacent parts. Each of the two ports 2 and 3 is curved, in this example, and extends from a flange 6 for connecting to a tract plenum (not represented) and in which the port 2 or 3 emerges via an inlet orifice at its upstream end, to a flange 7 for fixing to the cylinder head of the engine, and in which the port 2 or 3 emerges via its outlet orifice 8 at its downstream end. The flange 7 exhibits passage holes 9 for members for fixing the tract element 1 to the cylinder head of the engine so that each of the two outlet orifices 8 of the air ports 2 and 3 is directly facing respectively one of the two inlet valves of the associated cylinder or combustion chamber. Likewise the flange 6 exhibits passage holes 10 for members for fixing to the plenum.

When the engine is a multi-cylinder engine, and for example an engine with four in-line cylinders, the tract may comprise four tract elements 1 mounted side by side between a common plenum, to which each of them is fixed by its flange 6, and the cylinder head of the engine, to which each is fixed by its flange 7.

The cylinder or combustion chamber associated with each tract element 1 is supplied with fuel by an injector, the silhouette of which is represented as 11 in FIGS. 2 and 3, and which is of the multi-hole type and, in this example, of the two-hole type, that is to say delivering the fuel in the form of two jets diverging from one another and each intended to be introduced into respectively one of the two air ports 2 and 3.

To this end, the injector 11 is engaged and supported via its end delivering the two jets of fuel in a tubular skirt 12 arranged in the partition 5 to ensure the dispersion of the fuel which it receives from the injector 11 thus mounted substantially between the two ports 2 and 3 and the transfer of this fuel to the two air ports 2 and 3 under conditions liable to guarantee good preparation of the air/fuel mixture as it enters the cylinder head of the engine.

In this example, the skirt 12 is of a single piece with the tract element 1 because it is incorporated into the partition 5, being formed directly therein by a substantially cylindrical central bore 13 of axis substantially parallel to the axes of the downstream parts of the ports 2 and 3 (see FIGS. 2 and 3). The upstream end part 14 of the bore 13 exhibits preferably an axisymmetric shape of widened section forming a seat for the injector 11, whereas downstream of the injector 11, the central and downstream parts of the bore 13 are of a substantially constant section.

In the downstream end part of the bore 13, the skirt 12 is formed by two opposed lateral walls 15, each of which is thinned progressively into a bevel 16 with thickness and/or width decreasing from upstream to downstream as far as its free downstream edge 17 in the form of a thin blade, which exhibits a concave notch 18 with the concavity turned toward the downstream end and substantially symmetric with respect to the diametral mid-plane of the bore 13 corresponding to the sectioning plane III—III of FIG. 2. Between the bevels 16 which diverge toward the downstream end, one with respect to the other and with respect to the axis of the bore 13, thus delimiting between them a passage which diverges toward the downstream end, the opposed lateral walls 15 delimit two fuel passages 19 in communication with one another in the bore 13 inside the skirt 12 and each opening into one respectively of the ports 2 and 3 via an outlet orifice 20.

Each outlet orifice 20 is delimited between the notch 18 of one of the bevels 16 and a central partition element 21 with parallel walls, which diametrally extends the skirt 12 at its downstream end, so as to separate from one another the air ports 2 and 3 and the jets of fuel received by the latter coming from the passages 19.

The outlet orifices 20 preferably have parallel axes and are obtained by machining, as indicated in chain line in FIG. 3, simultaneously forming the bevels 16 and the notches 18 in the free edges 17, or by molding, in contrast with FIG. 9 of EP-A-0,544,978 in which the axes of the fuel passages are inclined by an angle Θ. This solution is, for the desired precision, more economical than the skirt produced in the form of a sleeve tube which, according to the teachings of EP-A-0,544,978, has to be machined and fitted into the wall which accommodates it in order to avoid substantial dispersion on the surface of the passage sections which is due to the non-zero value of the angle 8.

In addition, the skirt 12 is adapted, particularly in terms of length, to suit the injector 11 so that each of the two divergent jets of fuel coming from the injector 11 and represented diagrammatically as 22 in FIG. 3, hits a region 23 situated upstream of the bevel 16 and of the notch 18 on the internal face of one respectively of the opposed lateral walls 15.

Thus, each of the jets of fuel 22 is broken up on a lateral wall of the skirt 12, and the fuel from this jet is then dispersed and diffused by one respectively of the passages 19 of the skirt 12 into one respectively of the air ports 2 and 3, in which good air/fuel mixing takes place, by virtue of the whistle shaped configuration given to each outlet orifice 20 of the skirt 12 by the interaction between the bevel 16, its free edge 17 in the form of a thinned blade, and its concave notch 18.

The skirt 12 thus produces a post-atomization effect by using the trailing edges of the thinned blades 17 of its lateral walls 15 as a post-diffuser, bringing the post-diffusion thus provided closer to the outlet orifice 8 of the ports 2 and 3, and therefore closer to the corresponding inlet valves with respect to the tip of the injector 11, where the two jets of fuel 22 come out. In addition, these jets 22 are angularly recentered by striking the walls 15 at 23. This results in a certain degree of compensation for an excessive distance separating the tip of the injector 11 from the corresponding inlet valve or valves, and therefore in minimal formation of liquid films of fuel on the wall of the casing of the intake port in the cylinder head, and a relative insensitivity with respect to the angle of separation between the jets 22, substantially the same quality of atomization and of preparation of the air/fuel mixture being obtained irrespective of whether this angle of separation is of the order of 18° or of the order of 23°, for example.

FIGS. 4 and 5 represent an alternative which can be distinguished essentially from the embodiment of FIGS. 1 to 3 only in the shape of the central bore of the skirt and the structure of the opposed lateral walls forming the bevels. The latter here are formed by a divergent downstream part of the central bore of the skirt.

More precisely, in FIG. 4, the trailing edge in the form of a thinned blade 17' of each lateral wall 15' of the skirt 12' is formed at the downstream end of a divergent downstream part 13' of the central bore of this skirt 12', this divergent part 13' extending axially over most of the length of the skirt 12' and diverging progressively from a cylindrical throat 24 of smaller transverse section of the bore, directly downstream of the housing 14 of widened section at the upstream end of the skirt 12'. Thus the lateral walls 15' are progressively thinned toward the downstream end owing to the divergent part 13' of the bore and simultaneously to the shape of the wall delimiting the air ports 2 and 3. The central bore 13' and the contour of the concave notch 18' in the edge in the shape of a thinned blade 17' of a bevel 16' of the skirt 12' are represented in FIG. 5, corresponding to a partial and opened-out diametral section of FIG. 4.

The bevels 16' of this skirt 12' are thus formed by the opposed internal lateral faces of the downstream part of this divergent bore 13', and these bevels 16' may originate in the region of the tip of the injector 11. In interaction with a central partition element 21', of triangular section widening as far as the downstream end of the tract element, these bevels 16' delimit two fuel passages 19' which no longer have substantially parallel axes as in the preceding example of FIGS. 1 to 3, but are inclined with respect to one another so that they diverge with respect to one another toward the downstream end, the fuel diffused by each passage 19' after the corresponding jet coming from the injector 11 has struck the region 23' of the internal face of the corresponding lateral wall 15' followed by its post-atomization on the thinned blade 17' of this wall 15', as in the preceding example, being substantially guided by the corresponding bevel 16' and the opposite lateral face of the central wall element 21' which is substantially parallel to this bevel 16'.

In the alternative of FIG. 6, the bevels 16" of the opposed lateral walls 15" which are thinned toward the downstream end are also delimited on the internal face of a divergent downstream part 13" of the central bore of the skirt 12" and may also originate in the region of the tip of the injector 11. However, this divergent bore part 13" connects to the cylindrical throat 24' of the bore via a substantially radial shoulder 25 and, in addition, the upstream end, in the form of a thin blade, of the central wall element 21" is engaged axially toward the upstream end beyond the free edges 17" of the bevels 16" and between these, whereas in the alternative of FIGS. 4 and 5, the upstream end of the central wall element 21' is axially spaced in the downstream direction away from the free edges 17' of the bevels 16'.

In the alternative of FIG. 6, the divergent fuel passages 19" are thus better delimited and separated from one another, each between two substantially parallel faces, one of which is a bevel 16" and the other a lateral face of the upstream part of the central wall element 21".

A greater difference by comparison with the skirt 12' of FIGS. 4 and 5 is that the skirt 12" of FIG. 6 is short enough, bearing in mind the angle of separation of the jets from the injector 11, for these jets to pass freely, as represented in FIG. 6, through the space between the lateral walls 15" and into the passages 19" emerging in the air ports 2 and 3. The skirt 12" therefore produces a post-atomization effect only when a film of liquid fuel forms on the walls of the skirt 12".

In the alternatives of FIGS. 4 to 6, the fuel passages 19' or 19", as well as the bore parts 13' or 13", bevels 16' or 16" and free edges 17' or 17" which bound them, and the central partition element 21' or 21" may be produced more simply by making cylindrical drillings oriented along the inclined axes of the passages 19' or 19" in the partition for separating the air ports, starting from that face of the tract element which is turned toward the cylinder head of the engine, and as far as the throat 24 or the shoulder 25, the throat 24 or and the widened upstream end part 14 being machined from the other side of the tract element. These cylindrical drillings simultaneously produce the notches such as 18', with concavity turned toward the downstream end, in the free edges 17' or 17" of the opposed walls 15' or 15".

As an alternative, the fuel passages in the skirts may also be formed by parallel drillings in short skirts or alternatively by drillings which are inclined with respect to one another in long skirts.

In the three examples described hereinabove, the skirt 12, 12' or 12" is formed directly in the partition 5 separating the two air ports 2 and 3. However, in other alternatives which have not been represented, the skirt may be produced as described hereinabove but in the form of a removable piece which is fitted onto a tract element which may have a structure practically identical to the one of FIG. 1, the difference being that the skirt is fitted into a tubular housing formed in this partition 5. In another alternative which has also not been shown, such a removable skirt may be fitted directly into the cylinder head of the engine, being mounted in a tubular housing formed in a partition which partially delimits and separates two air ducts or ports formed directly in the cylinder head.

We claim:

1. A skirt for dispersing fuel received from a multi-hole injector and transferred into at least two air intake ports separated by a partition for supplying a combustion chamber of a fuel-injected internal combustion engine, the injector being arranged substantially between at least two air ports and the skirt, said skirt comprising a tubular overall shape having an upstream part exhibiting an axisymmetric shape, and a downstream part forming at least two fuel passages communicating with one another toward an inside of the skirt, said at least two fuel passages emerging respectively in said at least two air ports through an outlet orifice and being defined by two opposed lateral walls of the skirt wherein each of said opposed lateral walls progressively thins to a bevel of at least one of thickness and width decreasing from upstream to a downstream end comprising a downstream free edge, in a form of a thin blade, wherein said downstream free edge comprises a concave notch with concavity turned toward the downstream end.

2. The skirt according to claim 1, wherein each of said opposed lateral walls comprises an internal face which is intended to be struck, in a region upstream of said concave notch, by at least one jet of fuel coming from the injector.

3. The skirt according to claim 1, wherein each said bevel of said opposed lateral walls define a passage which diverges from upstream to downstream.

4. The skirt according to claim 1 comprising a central partition element wherein said central partition element and one of said two opposed lateral walls define an outlet orifice of each of said at least two fuel passages at the downstream end of the skirt in order to separate the at least two fuel passages and the at least two air ports.

5. The skirt according to claim 1, herein each said bevel of the opposed lateral walls are formed at a downstream end part of an axisymmetric central bore of the skirt.

6. The skirt according to claim 1, wherein each said bevel of opposed lateral walls are formed by a divergent downstream part of a central bore of the skirt.

7. The skirt according to claim 6, wherein said divergent downstream part connects to an axisymmetric throat of smaller transverse section of the central bore of the skirt by a substantially radial shoulder.

8. The skirt according to claim 6, wherein said divergent downstream part of the central bore diverges progressively from an axisymmetric throat of smaller transverse section of the central bore.

9. The skirt according to claim 6, wherein each said bevel of the opposed lateral walls originate in line with a tip of the injector.

10. The skirt according to claim 5, wherein said central bore comprises an upstream end part forming a seat for the injector.

11. The skirt according to claim 1 comprising an integral air intake tract element comprising at least two air ports associated with one combustion chamber, and extending between a first flange for connection to a tract plenum and a second flange for fixing to a cylinder head of an engine, in which said first flange and said second flange and the at least two air ports each emerge respectively through an inlet orifice at an upstream end and an outlet orifice at its downstream end, the skirt being incorporated into a partition which forms and separates the at least two ports.

12. The skirt according to claim 1, wherein the at least two fuel passages and their respective outlet orifices are formed about axes which are substantially parallel to one another.

13. The skirt according to claim 1 comprising a removable air intake tract element comprising at least two air ports associated with a combustion chamber and extending between a first flange for connection to a tract plenum and a second flange for fixing to a cylinder head of an engine, in which said first flange and said second flange and the at least two air ports each emerge respectively through an inlet orifice at an upstream end and through an outlet orifice at its downstream end, the skirt being fitted into a housing formed in a partition for forming and separating the at least two air ports.

14. The skirt according to claim 1, wherein said skirt is mounted removably in a housing made in a partition for forming and for separating the at least two air ports directly in a cylinder head of an engine.

* * * * *